United States Patent [19]

Phillips

[11] 4,242,843

[45] Jan. 6, 1981

[54] EXPANDABLE SANDING BLOCK FOR ENDLESS WRAP AROUND ABRASIVE BELTS

[76] Inventor: Jerry L. Phillips, 412-123rd Ave. SE., Lake Stevens, Wash. 98285

[21] Appl. No.: 966,065

[22] Filed: Dec. 4, 1978

[51] Int. Cl.[3] ..... B24D 15/00

[52] U.S. Cl. ..... 51/380; 51/391; 51/389; 15/233

[58] Field of Search ..... 51/363, 380, 389, 391, 51/392, 393, 358; 15/231, 232, 233

[56] References Cited

U.S. PATENT DOCUMENTS

| | | | |
|---|---|---|---|
| 485,923 | 11/1892 | Gage | 51/380 |
| 1,844,996 | 2/1932 | Walker | 51/391 |
| 2,275,766 | 3/1942 | Johnson | 51/380 |
| 2,414,036 | 1/1947 | Gerhan | 51/380 |
| 2,430,785 | 11/1947 | Scattone | 51/380 |
| 2,457,045 | 12/1948 | Kitterman | 51/380 |
| 2,493,852 | 1/1950 | Bonkowski | 51/380 |
| 2,531,588 | 11/1950 | Stucker | 51/380 |
| 2,761,257 | 9/1956 | Mendelsohn | 51/391 |
| 3,063,208 | 11/1962 | Bell et al. | 51/391 |

FOREIGN PATENT DOCUMENTS

| | | | |
|---|---|---|---|
| 537575 | 6/1941 | United Kingdom | 51/380 |

*Primary Examiner*—Harold D. Whitehead
*Assistant Examiner*—K. Bradford Adolphson
*Attorney, Agent, or Firm*—David L. Garrison; Ford E. Smith

[57] ABSTRACT

An improved sanding block is disclosed for receiving and tensioning a continuous or endless sandpaper or other abrasive wrap-around belt about the sanding block's periphery. The block effectively uses two parts, so shaped that when assembled within an endless abrasive belt, they provide a wedging action which effectively elongates or expands the periphery of the tool to properly tension the belt.

4 Claims, 5 Drawing Figures

EXPANDABLE SANDING BLOCK FOR ENDLESS WRAP AROUND ABRASIVE BELTS

BACKGROUND OF THE INVENTION AND PRIOR ART STATEMENT

This invention relates generally to abrasive tools and more particularly to sanding blocks used to support and tension a continuous abrasive belt about the periphery of the tool. Sanding blocks using endless sandpaper belts are known. U.S. Pat. No. 2,414,036 (Gerhan) discloses a sandpaper block of two parts having ratchet teeth or double wedges to provide an elongation of the tool body and thus a tensioning of a continuous abrasive belt wrapped about the periphery of the two part block. U.S. Pat. No. 2,430,785 (Scattone) discloses an abrasive board for jewelers utilizing a handle connected to a working section about which a number of continuous abrasive belts are held. The belts are tensioned by a wedge driven into the board at the end opposite the handle. Successive layers of abrasive material are exposed by removing spent belts using rip strings. U.S. Pat. No. 2,493,852 (Bonkowski) shows a teardrop shaped sanding block for use with continuous sanding belts. It employs a string or thumbscrew mechanism to elongate the tool thereby tensioning and encircling abrasive belts. U.S. Pat. No. 2,761,257 (Mendelsohn) discloses a sanding block in which tension is imparted to an abrasive belt through a spring and guide arrangement contained within an opposed pair of sanding block halves. U.S. Pat. No. 3,063,208 (Bell et al.) discloses a sanding block comprised of three main body pieces with a diagonally oriented screw advance mechanism which elongates the tool to tension a continuous abrasive belt around the periphery of the tool. These disclosures contain the most pertinent art known to this applicant.

SUMMARY OF THE INVENTION

The sanding block of this invention is a tool for receiving and tensioning a wraparound endless abrasive belt. The tool essentially includes a sanding block of right rectangular prismatic shape having a transversely disposed canted wedge-cavity at one end of the block preferably adjacent the top surface. The cavity consists essentially of a ledge surface that is located intermediate between the bottom of the block and its top surface, and an upright wedge wall angularly related to the ledge surface to thus form the canted cross-section of the cavity. The wedge wall of the cavity is disposed transversely of said block in a manner non-parallel to the end of the block. A wedge member is transversely slidable in the wedge-cavity. It rests on the ledge surface and has a wedging surface functionally related to the wedge wall of the block. The wedge member is operable during transverse sliding movement to apply tension to an endless abrasive belt wrapped around the tool.

Among the important features of the invention has been the provision of a block which has a continuous and uninterrupted bottom surface against which or in relation to which is disposed a working portion of an encircling and endless abrasive belt. It is important to avoid the working surface of the block having any aperatures or interruption so that a very smooth and uninterrupted sanding surface or other abrasive surface is presented to the work piece to be processed.

Another important feature of the block of this invention has been to provide means in the wedging cavity between the wedging member and the block that insures that the wedge and block remain together even though the wedge has been withdrawn from its tension-providing position. This avoids the accidental displacement or loss of the wedge when a belt is not encircling the parts that are under tension by them. Other important advantages such as simplicity in manufacture and ease in the use of the tool will become very apparent during the course of the following specifications. One such advantage is derived by providing, in juxtaposition to the broad and uninterrupted bottom surface of the block, a resilient pad or layer the size and thickness and density of which is a factor in controlling the amount of wedging action that is required of the interrelated and relatively movable parts. For example, it is desirable that the wedging action be easily accomplished. In order to do so the angle of the wedges should be as near the parallel direction of movement as possible. Stated differently, a very severe angular relationship requires considerable force to move the wedge relative the block. By insuring that the peripheral dimensions of the tool when the wedge is withdrawn from the wedging cavity to the degree permitted are such that the endless belt will be able to be easily slipped over the block, the pad on its bottom surface as well as the nose of the wedging number effectively controlled. With the abrasive belt slipped loosely in place, all that one need do is to press the wedge member into the wedging cavity almost purely a straight line movement and the tension will be applied to the belt and the tool is ready for use.

DESCRIPTION OF THE PREFERRED EMBODIMENTS OF THE INVENTION

Figure 1:
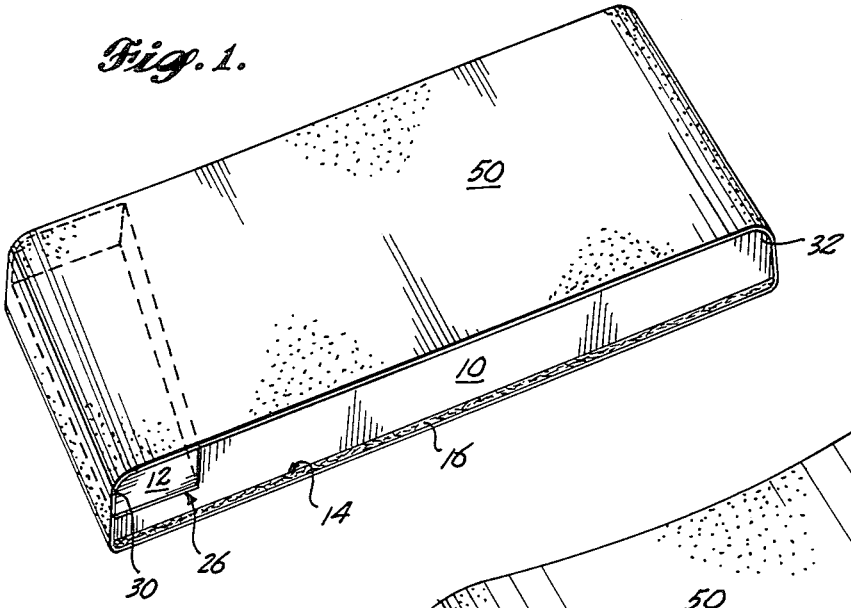
FIG. 1 is a perspective view of the sanding block of this invention.

The primary parts of this tool for receiving and tensioning a wrap around, endless abrasive belt are the elongated handy block 10 and the wedge member 12. The elongated handy block may have an uninterrupted right rectangular planar bottom surface 14 against which is normally juxtaposed a resilient sheet or pad 16. There are upstanding surfaces 18 and 20 at each end of the bottom surface and there is the overlying top surface 22 wherein is shown a plurality of voids 24 in the block for purposes of reducing its weight among others.

Figure 2:
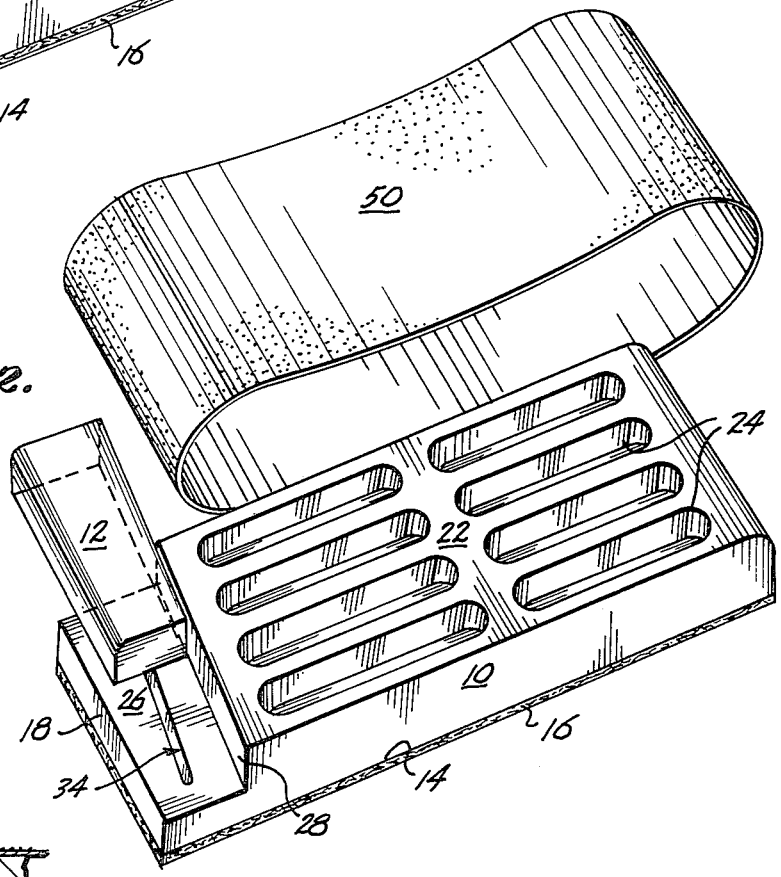
FIG. 2 is an exploded view in perspective of the parts of the sanding block of this invention.
Figure 3:
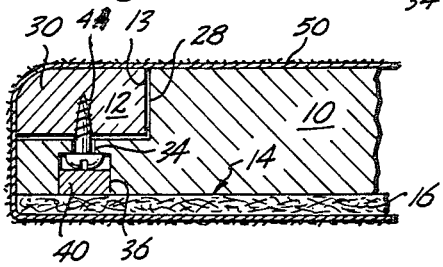
FIG. 3 is a fragmentary end section of the block showing certain guide means employed between the main part of the block and the movable wedging member.

As can be seen in FIGS. 2 and 3, there is means of forming a transversely disposed canted wedge-cavity. The cavity essentially comprises the ledge surface 26 and wedging surface 28. The ledge surface 26 is preferably parallel to the bottom surface 14 and lies approximately intermediate between the bottom surface of the block and its top surface 22. The wedge wall 28 is disposed transverse the block and canted at an angle to the end 18. In other words, the wedge wall 28 is non-parallel the end wall 18.

The wedge member 12 is transversely slidable on the ledge surface 26 of the described canted wedge cavity. Wedge 12 has a wedging surface 13 which functionally relates to wedge wall 28 and is operable during transverse sliding movement of the wedge member into the wedging cavity to provide tension on an endless abrasive belt wrapped about the parts of the tool.

Figure 4:
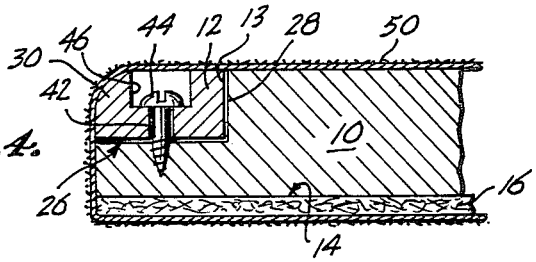
FIG. 4 is a modified form of assembly of the block.
Figure 5:
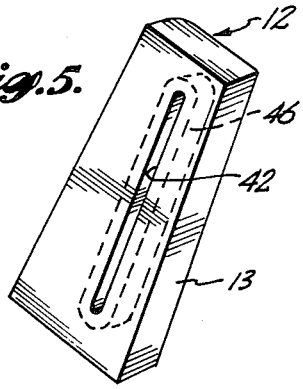
FIG. 5 is a perspective view of the underside of the wedge member of FIG. 4.

It is desirable that the wedge member be attached to the elongated handy block in such a way that when it has been displaced from the wedge cavity it remains coupled to the block, therefore is not easily lost or misplaced. This is accomplished in one way as shown in FIG. 3 and in an alternative manner as shown in FIG. 4. In the FIG. 3 form the ledge surface is provided with a narrow slot 34, which is enlarged and undercut below. A larger slot 36 is formed in the bottom 14 of block 10 and screw 44 is passed through the slot 34 and into wedge 12 from beneath, thus providing retaining means. The slots 34 and 36 of course permit the wedge 12 to move and to extend as shown in FIG. 2. A plug 40 may fill the undercut slot 36 and insures that the bottom 14 is uninterrupted and planar.

In FIG. 4 the retaining means is substantially the same except reversed as respects the FIG. 3 form. The wedge element 12 has slot 42 through which is passed screw 44, its head being disposed in an enlargement of the slot 42. Screw 44 passes through slot 42 and the edge surface 26 into the reduced thickness part of block 10. In this way the bottom surface 14 does not need to be plugged or otherwise smoothed to receive the pad 16 and the bottom run of the sanding belt.

An endless sanding belt 50 is shown in FIG. 2 as it appears disconnected from the tool. The endless abrasive belt 50 is also shown in the other views as it appears wrapped around the assembled tool.

The assembly and use of the tool should be reasonably apparent from the foregoing description. Assembly is accomplished by displacing the wedge member 12 from the wedging cavity as shown in FIG. 2. This permits, in part due to a looseness of the fit betwen the shank of screw 38 and the angled walls of slot 26, the periphery about which the belt 50 is to be passed to be reduced to a minimum. The belt is then smoothly slipped onto the body 10 from a side, preferably the near side in FIG. 2, until its side edges align with the side edges of block 10. The user of this tool then presses on the larger end of wedge number 12 forcing it into the canted wedging cavity above surface 26 and outward of surface 28. During this action the wedging surface 13 of the wedge 12 functionally coacts with the wedge wall 28 and tends to force or expand the surface 30 of wedge 12 outward. This transverse sliding movement of the wedge member applies tension on the inner surface of the endless abrasive belt 50 which is wrapped around the tool. When the ends of the wedge 12 become aligned with the sides of block 10, an appropriate tension will have been applied to the belt permitting it to be used as, for example, by carpenters and woodworkers as they commonly use sanding blocks.

While the invention has been described with specific reference to the preferred embodiment and one variation thereof to fulfill the objects as above stated, it will be apparent that various modifications and changes may readily be made by one of ordinary skill in this art without departing from the scope and fair meaning of the invention as set forth in the claims which follow.

I claim:

1. An abrading tool comprising:

a wrap-around, endless abrasive belt, an elongated block having an uninterrupted right-rectangular planar bottom surface, upstanding surfaces substantially right-angularly disposed relative to each end of said bottom surface, and an overlying top surface;

means forming a transversely disposed wedge-cavity at one end of said top surface, said cavity consisting essentially of a ledge surface and an upright wedge wall angularly related to each other;

said ledge surface being located in said block intermediate between said bottom surface and its top surface;

said wedge wall being disposed transverse said block non-parallel to its adjacent upstanding end surface; and a wedge member transversely slidable on the ledge surface relative said wedge cavity, said wedge member having a wedging surface functionally and frictionally related to said wedge wall, said wedge member being operable during the transverse sliding movements relative said wedge cavity to apply tension on said endless abrasive belt wrapped around said block.

2. A tool according to claim 1 in which there is:

interfitted means forming an interlock between said wedge member and one of said surfaces of said cavity whereby containing force exerted by the tightened abrasive belt produces friction in said interfitted means to produce said interlock.

3. A tool according to claim 2 in which the slidable interlock comprises:

a guideway and a guideway follower between said wedge member and one of said surfaces of said cavity.

4. A tool according to claim 3 in which the guideway follower is carried by said wedge member.

* * * * *